US006832390B1

(12) United States Patent
Kleinert et al.

(10) Patent No.: US 6,832,390 B1
(45) Date of Patent: Dec. 21, 2004

(54) LEG GUARD STRAPPING SYSTEM

(75) Inventors: James M. Kleinert, Louisville, KY (US); David M. Timbeck, London (CA); Dave L. T. Wilcox, Lucan (CA)

(73) Assignee: Hillerich & Bradsby Co., Louisville, KY (US)

( * ) Notice: Subject to any disclaimer, the term of this patent is extended or adjusted under 35 U.S.C. 154(b) by 0 days.

(21) Appl. No.: 10/819,541

(22) Filed: Apr. 7, 2004

(51) Int. Cl.[7] ..... A41D 13/00
(52) U.S. Cl. ..... 2/22
(58) Field of Search ..... 2/22, 455, 24, 2/62, 16, 44, 45, 908, 911; 128/878, 882; 602/20, 23, 26, 62

(56) References Cited

U.S. PATENT DOCUMENTS

| | | | | | |
|---|---|---|---|---|---|
| 833,546 | A | * | 10/1906 | Pierce | 2/22 |
| 1,378,870 | A | | 4/1921 | Kauffman | |
| 1,560,825 | A | | 11/1925 | Kelticka | |
| 1,571,088 | A | | 1/1926 | Buchanan | |
| 2,626,394 | A | | 1/1953 | Davis | |
| 3,898,697 | A | * | 8/1975 | Whitehead | 2/22 |
| 4,888,826 | A | * | 12/1989 | Parsons et al. | 2/22 |
| 5,093,931 | A | | 3/1992 | LaBerge et al. | |
| 6,226,797 | B1 | | 5/2001 | Tollini | |
| 6,311,337 | B1 | | 11/2001 | Tollini | |
| 6,687,912 | B2 | | 2/2004 | Collins et al. | |
| 2002/0162153 | A1 | | 11/2002 | Collins et al. | |

* cited by examiner

*Primary Examiner*—Tejash Patel
(74) *Attorney, Agent, or Firm*—Charles G. Lamb; Middleton Reutlinger

(57) ABSTRACT

A Y-shaped strap system is provided for a leg guard wherein two legs of the Y-shaped strap system are attached to one edge of a shell of the leg guard and a third leg is detachably connectable to an opposed edge of the shell of the leg guard. A V-shaped connector is provided to attach the first and second legs to the third leg.

18 Claims, 3 Drawing Sheets

LEG GUARD STRAPPING SYSTEM

BACKGROUND OF THE INVENTION

1. Field of the Invention

The present invention relates, generally, to a leg strapping system for a leg guard. More particularly, the present invention relates to a Y-shaped strapping system for a protective leg guard with only one detachable connecting means.

2. Description of the Related Art

The use of leg guards by hockey goalies, baseball catchers and the like, are well known. These leg guards are to protect, for example, baseball catchers from thrown or batted balls, from bats and the like, while the catcher is in a standing, kneeling or squatting position. Moreover, leg guards are commonly used by hockey goalies to protect the goalie from flying pucks. In the use of these leg guards, the leg guards are, in many cases, removed and placed back up on the legs of the user many times during a single game. However, many of the strapping systems in present use for placing and removing the guards from players require considerable time by the player as a plurality of connector belts and straps are used in the leg guard strapping systems.

SUMMARY OF THE INVENTION

It is an object of the present invention to provide a leg guard for baseball catchers, hockey goalies and the like which is easy to be put on or removed.

It is another object of the present invention to provide a leg strapping system for a leg guard which includes only one detachable strap connection for attaching the leg guard to a user.

It is yet another object of the present invention to provide a leg guard strapping system of Y-shaped configurations with two terminating ends of the Y being permanently or semi-permanently attached along one edge of the leg guard and an opposed single strap is detachably connectable to an opposed edge of the leg guard.

Also, an object of the present invention is to provide a Y-shaped strap system for a protective leg guard which includes strap adjusting devices therein for lengthening or shortening of the strap system to accommodate users with different sized legs.

More particularly, the present invention provides a leg guard having an outer surface, an inner surface, and opposed first and second edges extending along the periphery of the surfaces wherein the inner surface is configured to receive a leg therein. A Y-shaped strap system is provided to strap the leg guards in place to protect the shin portion of the leg of the wearer. First and second leg straps define a V-shaped portion of the Y-shaped strap system. A first end of the first leg strap is attached along an upper portion of the first edge and a first end of the second leg strap is attached along a lower portion of the first edge. A third leg strap is provided wherein the third strap has a first end which is detachably connectable to a middle portion of the second edge. The third strap is provided with a second end opposed to the first end which is attached to second ends of the first and second straps. The location of the Y-strap follows the shape of the posterior aspect of the leg and the calf muscles. The top portion of the strap is above and proximal to the maximum convex area of the calf and the lower strap is below and distal to this region.

Other objects, advantages and features of the present invention will be more fully understood when the following portions of the specification are read in conjunction with the accompanying drawings.

DETAILED DESCRIPTION OF THE PREFERRED INVENTION

Figure 1:
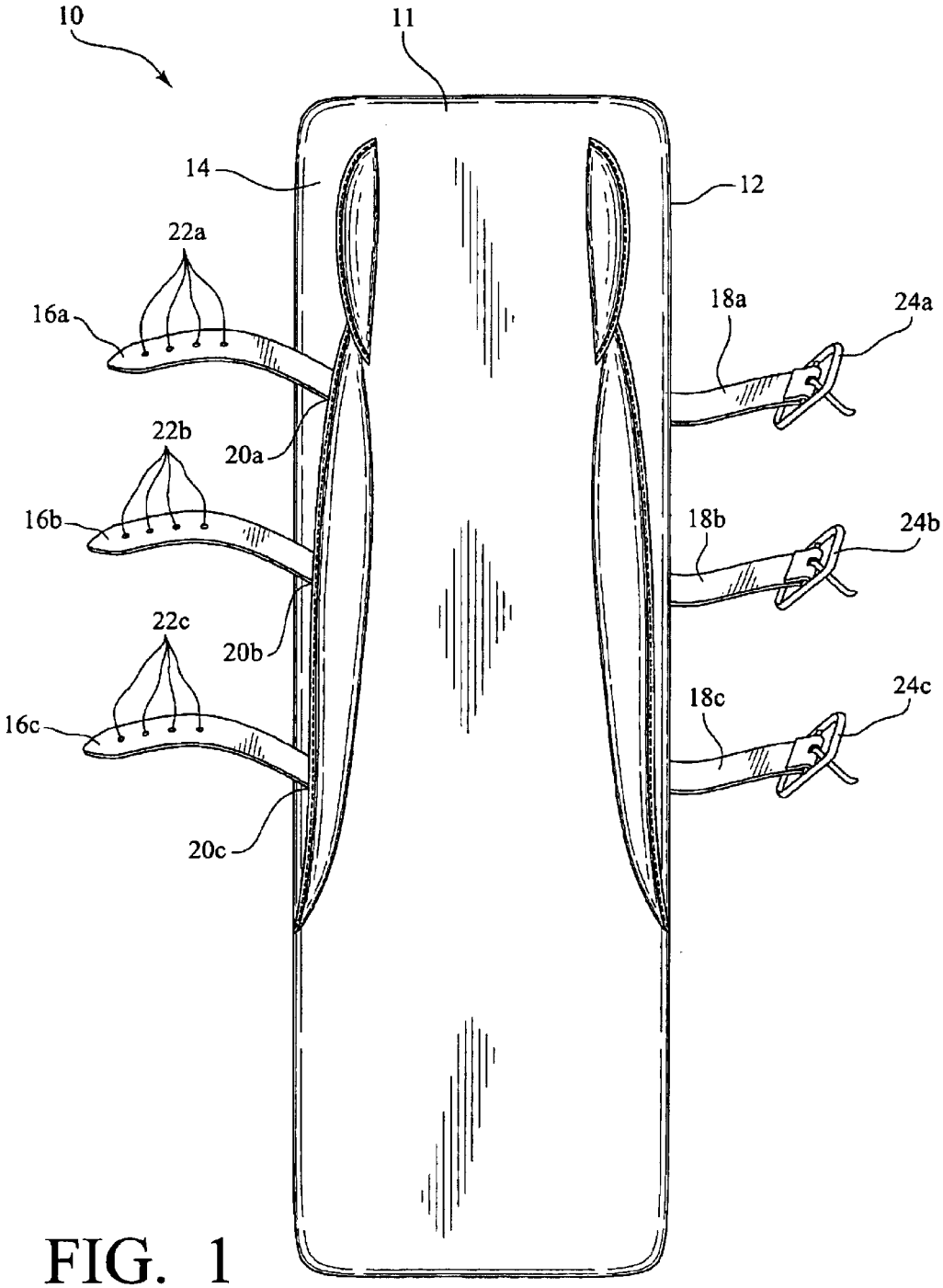
FIG. 1 (Prior Art)
FIG. 1 is a back of a prior art leg guard showing the strapping system in a non-use condition.

In FIG. 1 is shown a leg guard 10 with a prior art strapping system. The leg guard 10 is provided with a shell 11 for receiving the lower portion of a leg (not shown) therein. Shell 11 is provided with an outside edge 12 and an inside edge 14. Inside straps 16*a*, 16*b*, and 16*c* are attached at one end at pre-selected spaced distances along the inside edge 14. Attaching devices which may be rivets, sewn connections or the like, identified as 20*a*, 20*b* and 20*c* are noted to define the location of the attachment of the straps 16*a*, 16*b* and 16*c* to the inside edge 14. Opposed ends of the straps 16*a*, 16*b* and 16*c* are provided with a plurality of holes 22*a*, 22*b* and 22*c*, respectively, to represent the plurality of holes necessary for attaching to belt buckles 24*a*, 24*b* and 24*c* which are attached to an end of outside edge strap 18*a*, 18*b* and 18*c*, respectively. That is, depending upon the desired length of a strap, one of the plurality of holes identified by 22*a*, 22*b* or 22*c* is received by a belt buckle 24*a*, 24*b* or 24*c*, respectively, depending upon the adjustment for the thickness of the leg which is received by the leg guard 10.

Figure 2:
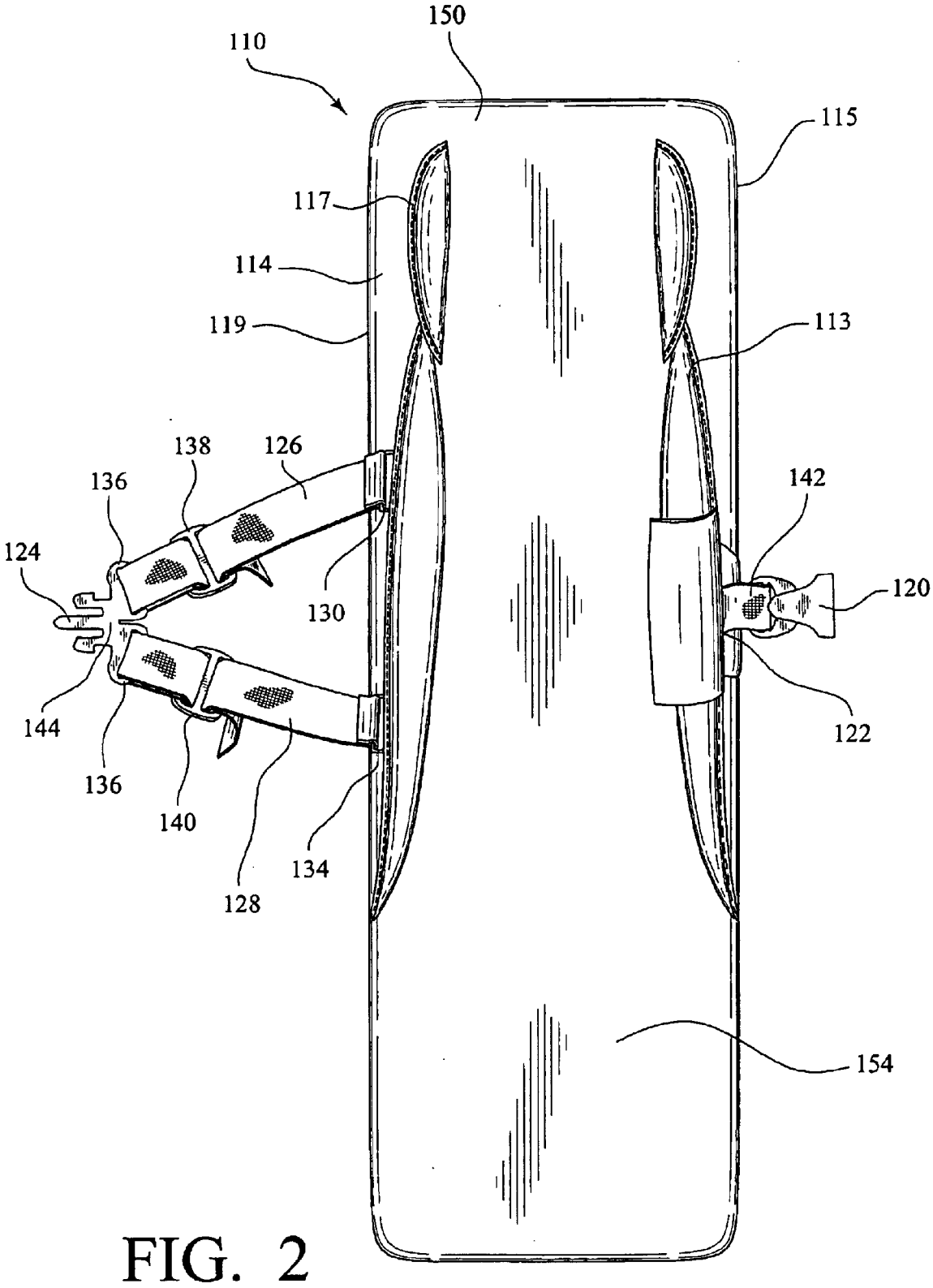
FIG. 2 is a back view of a leg guard with a Y-shaped strapping system of the present invention in a non-use condition; and, FIG. 3 is a side view of the leg guard of FIG. 2 in a use condition.
Figure 3:
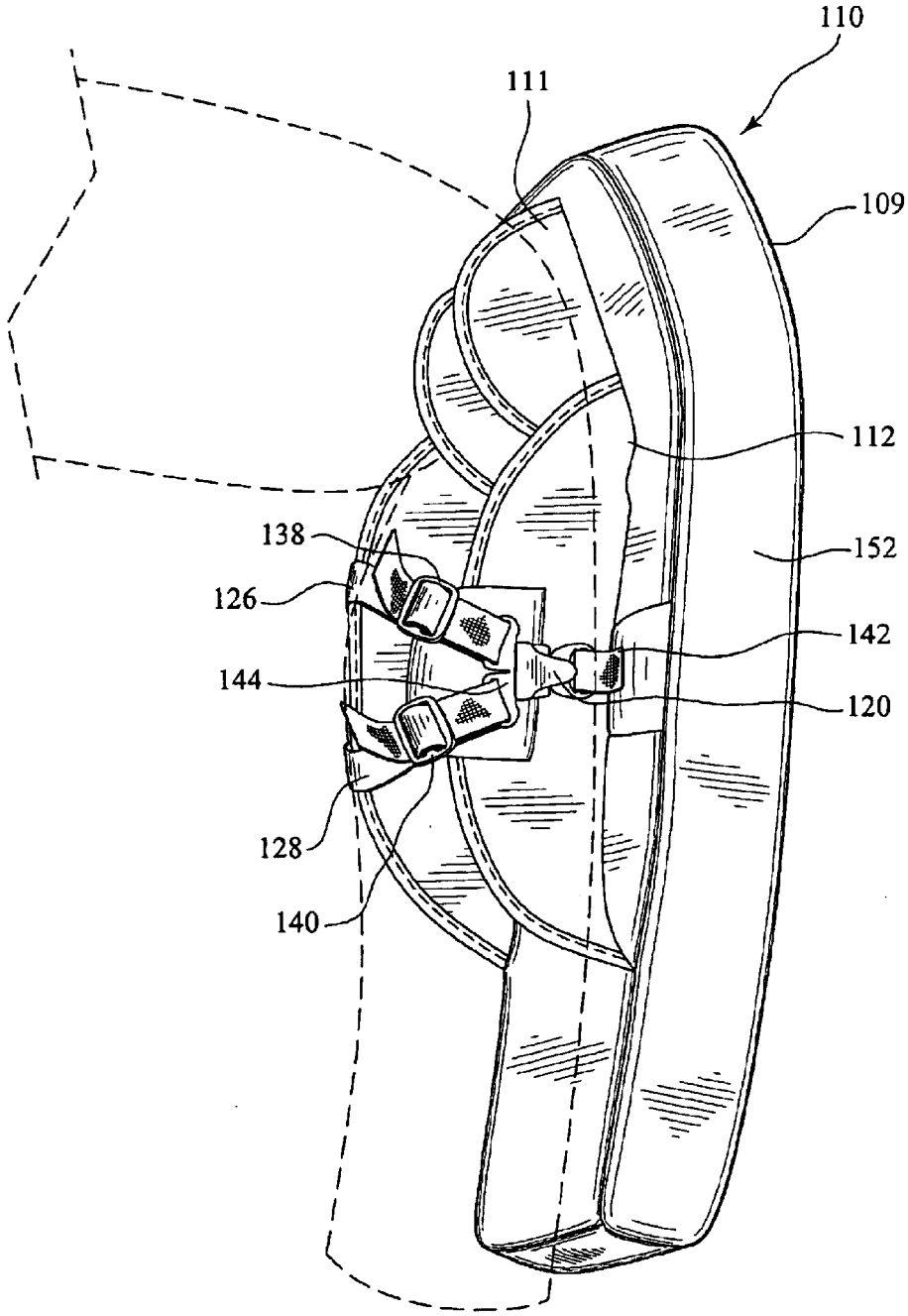

As shown in FIGS. 2 and 3, a leg guard 110 of the present invention is provided with an outer surface 109 and an inner surface 111 for receiving a leg, as shown in phantom lines in FIG. 3 therein. Inner surface 111 is provided with an inside or first edge 114 which is defined by the inner calf support member 117 and the inner guard edge 119 which extends along an inside of a leg and an outside or second edge 114 which extends along the outside of the leg defined by the outer calf support member 113 and the outer guard edge 115. A Y-strap system 116 is provided with three leg straps for attachment to the edges 112 and 114. The first leg strap, identified by the numeral 126 of the Y-shaped strap system 116, is fixedly attached to the edge 114 along an upper portion of the edge 114 by an attaching device, such as a ring or loop, identified by the numeral 130, which is sewn to the edge 114. An opposed end of the first leg strap 126 is provided with a ring or loop 134 thereon which receives one end of a V-shaped connector 144. The first leg strap 126 may also include an adjusting device 138 therein which provides for an adjustment of the length of the first leg strap 126.

A second leg strap 128 is attached to a lower portion of the inside edge 114 with a metal or plastic loop 134. An opposed end of the second leg 128 is also attached to a loop identified by the numeral 136 which attaches to a second end of the V-shaped connector 144. An adjusting device 140 may also be provided within the leg 128 to provide an adjustment mechanism for the length of the second leg strap 128.

A third leg strap identified by the numeral 142 is attached to a middle portion of the outside edge 112 with a ring or loop 122 which is sewn to the outside edge 112. An opposed end of the third leg 142 is provided with a buckle 120 for mating with a W-shaped catch 124 which is at the apex of the V-shaped connector 144.

In use, the adjusting devices 138 and 140 may be used to manipulate and thereby define the length of the first and second leg straps 126 and 128, respectively, to accommodate the lower leg size or thickness of an individual user. In use, merely snapping the buckle 120 into mating catch 124 enables easy attaching of the leg guard 110 to a user or detaching the leg guard from a user as desired. Preferably, as shown in FIG. 3, the V-connector 144 and the third strap 142 are positioned along the outer portion of the leg so the first strap 126 is above and proximal to the maximum convex area of the calf and the second strap 128 is below and distal to the convex area of the calf.

Modifications to the preferred embodiment will become apparent to those skilled in the art to which it pertains without deviation from the scope and spirit of the present invention as set forth in the appended claims.

What is claimed is:

1. A leg guard comprising:

an outer surface, an inner surface, and opposed first and second edges extending along the periphery of said surfaces, said inner surface configured to receive a leg therein;

a Y-shaped strap system comprising:

a first leg strap having a first end attached along an upper portion of said first edge and an opposed end attached to a first end of a V-shaped connector;

a second leg strap having a first end attached along a lower portion of said first edge and an opposed second end attached to a second end of a V-shaped connector; and a third leg strap having a first end detachably connected to a middle portion of said second edge, said third strap having a second end opposed to said first end and attached to the apex of said V-shaped connector.

2. The leg guard of claim 1, said first end of said first leg strap and the first end of said second leg strap being permanently attached to said first edge.

3. The leg guard of claim 1, said V-shaped connector having a catch at its apex, said catch being in mating relation with a buckle, said buckle being at said second end of said third strap.

4. The leg guard of claim 1, said first leg strap and said second leg strap each having an adjusting device therein thereby providing for lengthening or shortening, individually, each of said first or said second leg straps.

5. The leg guard of claim 1, said first leg strap being positioned to be above and proximal to the maximum convex area of the calf and the second leg strap being positioned to be below and distal to the maximum convex area of the calf.

6. The leg guard of claim 1, said first edge being positioned to extend along an inside of a leg.

7. In combination with a leg guard having an outer surface, an inner surface, and opposed first and second edges extending along the periphery of said surfaces, said inner surface configured to receive a leg therein, the improvement comprising;

a Y-shaped strap system comprising:

a first leg strap having a first end attached along an upper portion of said first edge and an opposed second end attached to a first end of a V-shaped connector;

a second leg strap having a first end attached along a lower portion of said first edge and an opposed second end attached to a second end of a V-shaped connector; and a third leg strap having a first end detachably connected to a middle portion of said second edge, said third strap having a second end opposed to said first end and attached to the apex of said V-shaped connector.

8. The combination of claim 7, said first end of said first leg strap and the first end of said second leg strap being permanently attached to said first edge.

9. The combination of claim 7, said V-shaped connector having a catch at its apex, said catch being in mating relation with a buckle, said buckle being at said second end of said third strap.

10. The combination of claim 7, said first leg strap and said second leg strap each having an adjusting device therein thereby providing for lengthening or shortening, individually, each of said first or said second leg straps.

11. The combination of claim 7, said first edge being positioned to extend along the inside of a leg.

12. The leg guard of claim 7, said first leg strap being positioned to be above and proximal the maximum convex area of the calf and the second leg strap being positioned to be below and distal to the maximum convex of the calf.

13. A leg guard comprising:

an outer surface, an inner surface, and opposed first and second edges extending along the periphery of said surfaces, said inner surface configured to receive a leg therein;

a Y-shaped strap system comprising:

a first leg strap having a first end attached along an upper portion of said first edge;

a second leg strap having a first end attached along a lower portion of said first edge; and a third leg strap having a first end detachably connected to a middle portion of said second edge, each of said first leg strap, said second leg strap and said third leg strap having opposed second ends connected together.

14. The leg guard of claim 13, a first end of said first leg strap and a first end of said second leg strap being permanently attached to said first edge.

15. The leg guard of claim 13 including a V-shaped connector to which said opposed second ends of said first, said second, and said third straps are connected, said connector having a catch at its apex, said catch being in mating relation with a buckle, said buckle attached to said third strap.

16. The leg guard of claim 13, said first leg strap and said second leg strap each having an adjusting device therein thereby providing for lengthening or shortening, individually, each of said first or said second leg straps.

17. The leg guard of claim 13, said first edge being positioned to extend along an inside of a leg.

18. The leg guard of claim 13, said first leg strap being positioned to be above and proximal the maximum convex area of the calf and the second leg strap being positioned to be below and distal the maximum convex area of the calf.

* * * * *